US010134255B2

(12) United States Patent
Miwa

(10) Patent No.: US 10,134,255 B2
(45) Date of Patent: Nov. 20, 2018

(54) DIGITAL FUTURE NOW SECURITY SYSTEM, METHOD, AND PROGRAM

(71) Applicant: TECHNOMIRAI CO., LTD., Tokyo (JP)

(72) Inventor: Kazuo Miwa, Tokyo (JP)

(73) Assignee: TECHNOMIRAI CO., LTD., Tokyo (JP)

( * ) Notice: Subject to any disclaimer, the term of this patent is extended or adjusted under 35 U.S.C. 154(b) by 0 days.

(21) Appl. No.: 15/554,948

(22) PCT Filed: Mar. 3, 2015

(86) PCT No.: PCT/JP2015/056258

§ 371 (c)(1),
(2) Date: Aug. 31, 2017

(87) PCT Pub. No.: WO2016/139758

PCT Pub. Date: Sep. 9, 2016

(65) Prior Publication Data

US 2018/0047274 A1 Feb. 15, 2018

(51) Int. Cl.
*G07C 9/00* (2006.01)
*G08B 21/04* (2006.01)
(Continued)

(52) U.S. Cl.
CPC ..... *G08B 21/0423* (2013.01); *G07C 9/00* (2013.01); *G07C 9/00111* (2013.01);
(Continued)

(58) Field of Classification Search
None
See application file for complete search history.

(56) References Cited

U.S. PATENT DOCUMENTS 6,396,534 B1 * 5/2002 Mahler ..... G08B 13/19602 348/155
8,380,176 B2 * 2/2013 Adler ..... H04M 3/42178 455/414.1
(Continued)

FOREIGN PATENT DOCUMENTS

JP 2003-281694 A 10/2003
JP 2008-307969 A 12/2008
(Continued)

OTHER PUBLICATIONS

International Search Report issued in Application No. PCT/JP2015/056258, dated May 26, 2015.

*Primary Examiner* — Fekadeselassie Girma
(74) *Attorney, Agent, or Firm* — Michael Best & Friedrich LLP

(57) ABSTRACT

Provided is a digital future-now security system, method, and program capable of preventing an improper behavior, etc., of a person who is not excluded by conventional security checks. A digital future-now security system (1000) comprises a behavior pattern DB (115) that accumulates behavior patterns, the behavior pattern is positions of a mobile terminal device (30) on a layout, and stores them as normal patterns, and a behavior pattern determination function unit (112) that determines whether a behavior pattern, at the time of acquisition of positional information of the mobile terminal device (30), corresponds to the "normal pattern" stored in the behavior pattern DB (115), and issues a warning when the behavior pattern deviates from the "normal pattern" and any other mobile terminal device (30) is not present within a predetermined distance from the position.

5 Claims, 11 Drawing Sheets

(51) Int. Cl.
*G08B 25/01* (2006.01)
*G08B 13/196* (2006.01)

(52) U.S. Cl.
CPC ... *G07C 9/00571* (2013.01); *G08B 13/19613* (2013.01); *G08B 25/016* (2013.01); *G07C 9/00563* (2013.01); *G07C 2009/00769* (2013.01)

(56) References Cited

U.S. PATENT DOCUMENTS 9,728,055 B2 * 8/2017 Baldwin ..... G08B 13/19682
9,939,955 B2 * 4/2018 Bahrs ..... H04W 4/90
2007/0129113 A1 * 6/2007 Klicpera ..... H04M 1/7253 455/567
2007/0224980 A1 * 9/2007 Wakefield ..... G08B 13/1427 455/418
2009/0088207 A1 * 4/2009 Sweeney ..... H04M 19/04 455/557
2010/0074112 A1 * 3/2010 Derr ..... H04L 41/12 370/232
2010/0090827 A1 * 4/2010 Gehrke ..... G08B 21/0269 340/539.13
2014/0277607 A1 9/2014 Nixon et al.
2014/0313013 A1 * 10/2014 de Lorenzo ..... G08B 25/016 340/7.51
2015/0180746 A1 * 6/2015 Day, II ..... H04L 51/16 455/405
2015/0229752 A1 * 8/2015 Coles ..... H04M 1/72541 455/564
2015/0296187 A1 * 10/2015 Baldwin ..... G08B 13/19682 348/143
2015/0348498 A1 * 12/2015 Anderson ..... G06F 3/147 345/520
2016/0129883 A1 * 5/2016 Penilla ..... B60R 25/305 348/148
2016/0245665 A1 * 8/2016 Logan ..... G07C 3/00
2016/0301849 A1 * 10/2016 E ..... H04M 1/72533
2017/0014089 A1 * 1/2017 Murakami ..... A61B 5/746
2017/0149795 A1 * 5/2017 Day, II ..... H04W 4/02
2017/0208169 A1 * 7/2017 Day, II ..... H04L 51/16
2017/0301218 A1 * 10/2017 Tung ..... G08B 25/016
2017/0334348 A1 * 11/2017 Trinh ..... G06F 3/167
2018/0011594 A1 * 1/2018 Bahrs ..... H04W 4/90

FOREIGN PATENT DOCUMENTS

JP 2012-216119 A 11/2012
JP 2014-224799 A 12/2014

* cited by examiner

FIG. 4

| ROOM NAME, FACILITY NAME | *1 | *2 | *3 | *4 | *5 |
|---|---|---|---|---|---|
| (1) FACILITY DOORWAY | ○ | ○ | ○ | ○ | ○ |
| (2) RECEPTION CORNER | ○ | ○ | ○ | ○ | ○ |
| (3) LOBBY | ○ | ○ | ○ | ○ | ○ |
| (4) ELEVATOR | ○ | ○ | ○ | ○ | ○ |
| (5) STAIRS ON 1F | ○ | ○ | ○ | ○ | ○ |
| (6) INTERVIEW CORNER | ○ | ○ | ○ | ○ | ○ |
| (7) OFFICE KITCHENETTE | ○ | ○ | ○ | ○ | ○ |
| (8) WC | ○ | ○ | ○ | ○ | ○ |
| (9) DATA ROOM | × | ○ | ○ | ○ | ○ |
| (10) PRODUCT DEVELOPMENT OFFICE ROOM | × | ○ | ○ | ○ | ○ |
| (11) AUTHORIZED MANAGER ROOM | × | ○ | △ | ○ | △ |
| (12) PERSONS A1 TO A3 IN CHARGE | × | ○ | △ | △ | △ |
| (13) PERSON A4 IN CHARGE | × | ○ | △ | △ | △ |
| (14) PERSON A5 IN CHARGE | × | ○ | △ | △ | △ |
| (15) PERSON A6 IN CHARGE | × | ○ | △ | △ | △ |
| (16) PERSON A7 IN CHARGE | × | ○ | △ | △ | △ |
| (17) PERSON A8 IN CHARGE | × | ○ | △ | △ | △ |
| (18) PERSON A9 IN CHARGE | × | ○ | △ | △ | △ |
| (19) PERSON A10 IN CHARGE | × | ○ | △ | △ | △ |
| (20) MEETING ROOM ON 1F | × | ○ | △ | △ | △ |
| (21) IG MANAGER ROOM | × | ○ | △ | ○ | △ |
| (22) EXECUTIVE-IN-CHARGE ROOM | × | ○ | △ | △ | ○ |

*1: VISITOR
*2: PERSON IN CHARGE
*3: MANAGER
*4: AUTHORIZED MANAGER
*5: EXECUTIVE

△: ○ IN WITNESS

FIG. 5A

A. NORMAL MANAGEMENT STRUCTURE TABLE ACCORDING TO WORK PROGRAM

| ROOM NAME, FACILITY NAME | 7:00 | 9:00 | 11:00 | 13:00 | 15:00 | 17:00 | 19:00 | 21:00 | 23:00 | 1:00 | 3:00 | 5:00 |
|---|---|---|---|---|---|---|---|---|---|---|---|---|
| (1) FACILITY DOORWAY | S1 | S1 | S1 | S1 | S | S | S2 | S2 | S2 | BUSINESS IS CLOSED | | |
| (2) RECEPTION CORNER | S1 | S1 | S1 | S1 | S | S | S2 | S2 | S2 | | | |
| (3) LOBBY | S1 | S1 | S1 | S1 | S | S | S2 | S2 | S2 | | | |
| (4) ELEVATOR | S1 | S1 | S1 | S1 | S | S | S2 | S2 | S2 | | | |
| (5) STAIRS ON 1F | S1 | S1 | S1 | S1 | S | S | S2 | S2 | S2 | | | |
| (6) INTERVIEW CORNER | S1 | S1 | S1 | S1 | S | S | S2 | S2 | S2 | | | |
| (7) OFFICE KITCHENETTE | S1 | S1 | S1 | S1 | S | S | S2 | S2 | S2 | | | |
| (8) WC | S1 | S1 | S1 | S1 | S | S | S2 | S2 | S2 | | | |
| (9) DATA ROOM | S1 | S1 | S1 | S1 | S | S | S2 | S2 | S2 | | | |
| (10) PRODUCT DEVELOPMENT OFFICE ROOM | S1 | S1 | S1 | S1 | S | S | S2 | S2 | S2 | | | |
| (11) AUTHORIZED MANAGER ROOM | S1 | S1 | S1 | S1 | S | S | S2 | S2 | S2 | | | |
| (12) PERSONS A1 TO A3 IN CHARGE | S1 | S1 | S1 | S1 | S | S | S2 | S2 | S2 | | | |
| (13) PERSON A4 IN CHARGE | S1 | S1 | S1 | S1 | S | S | S2 | S2 | S2 | | | |
| (14) PERSONS A5 TO A9 IN CHARGE | S1 | S1 | S1 | S1 | S | S | S2 | S2 | S2 | | | |
| (15) PERSON A10 IN CHARGE | S1 | S1 | S1 | S1 | S | S | S2 | S2 | S2 | | | |
| (16) MEETING ROOM ON 1F | S1 | S1 | S1 | S1 | S | S | S2 | S2 | S2 | | | |
| (17) IG MANAGER ROOM | S1 | S1 | S1 | S1 | S | S | S2 | S2 | S2 | | | |
| (18) EXECUTIVE-IN-CHARGE ROOM | S1 | S1 | S1 | S1 | S | S | S2 | S2 | S2 | | | |
| AUTHORIZED SUB-MANAGER | | | | | | K2 | K2 | K2 | K2 | | | |
| AUTHORIZED CHIEF MANAGER | K | K | K | K | K | | | | | | | |

AUTHORIZED CHIEF MANAGER: K; AUTHORIZED SUB-MANAGER: K2; MANAGER: S; SUB-MANAGER: S1, S2

FIG. 5B

B. EMERGENCY SPECIAL MANAGEMENT STRUCTURE TABLE ACCORDING TO WORK PROGRAM

| ROOM NAME, FACILITY NAME | 7:00 | 9:00 | 11:00 | 13:00 | 15:00 | 17:00 | 19:00 | 21:00 | 23:00 | 1:00 | 3:00 | 5:00 |
|---|---|---|---|---|---|---|---|---|---|---|---|---|
| (1) FACILITY DOORWAY | S1 | S1 | S1 | S1 | S | S | S2 | S2 | S2 | BUSINESS IS CLOSED | | |
| (2) RECEPTION CORNER | S1 | S1 | S1 | S1 | S | S | S2 | S2 | S2 | | | |
| (3) LOBBY | S1 | S1 | S1 | S1 | S | S | S2 | S2 | S2 | | | |
| (4) ELEVATOR | S1 | S1 | S1 | S1 | S | S | S2 | S2 | S2 | | | |
| (5) STAIRS ON 1F | S1 | S1 | S1 | S1 | S | S | S2 | S2 | S2 | | | |
| (6) INTERVIEW CORNER | S1 | S1 | S1 | S1 | S | S | S2 | S2 | S2 | | | |
| (7) OFFICE KITCHENETTE | S1 | S1 | S1 | S1 | S | S | S2 | S2 | S2 | | | |
| (8) WC | S1 | S1 | S1 | S1 | S | S | S2 | S2 | S2 | | | |
| (9) DATA ROOM | S1 | S1 | S1 | S1 | S | S | S2 | S2 | S2 | | | |
| (10) PRODUCT DEVELOPMENT OFFICE ROOM | S1 | S1 | S1 | S1 | S | S | S2 | S2 | S2 | | | |
| (11) AUTHORIZED MANAGER ROOM | S1 | S1 | S1 | S1 | S | S | S2 | S2 | S2 | | | |
| (12) PERSONS A1 TO A3 IN CHARGE | S1 | S1 | S1 | S1 | S | S | S2 | S2 | S2 | | | |
| (13) PERSON A4 IN CHARGE | S1 | S1 | S1 | S1 | S | S,K | S2 | S2 | S2 | | | |
| (14) PERSONS A5 TO A9 IN CHARGE | S1 | S1 | S1 | S1 | S | S | S2 | S2 | S2 | | | |
| (15) PERSON A10 IN CHARGE | S1 | S1 | S1,K | S1 | S | S | S2 | S2 | S2 | | | |
| (16) MEETING ROOM ON 1F | S1 | S1 | S1 | S1 | S | S | S2 | S2 | S2 | | | |
| (17) IG MANAGER ROOM | S1 | S1 | S1 | S1 | S | S | S2 | S2 | S2 | | S2,K | |
| (18) EXECUTIVE-IN-CHARGE ROOM | S1 | S1 | S1 | S1 | S | S | S2 | S2 | S2 | | | |
| AUTHORIZED SUB-MANAGER | | | | | | K2 | K2 | K2 | K2 | | | |
| AUTHORIZED CHIEF MANAGER | K | K | K | K | K | | | | | K | K | K |

AUTHORIZED CHIEF MANAGER: K; AUTHORIZED SUB-MANAGER: K2; MANAGER: S; SUB-MANAGER: S1, S2

DIGITAL FUTURE NOW SECURITY SYSTEM, METHOD, AND PROGRAM

TECHNICAL FIELD

The present invention relates to a digital future-now security system, method, and program to prevent action of a suspicious person in a surveillance target area.

BACKGROUND ART

For information management, security guards or security cameras, a pass card, fingerprint authentication, and a security code, etc. have been installed at a doorway or a gate to control access of suspicious persons and outsiders and improve security to work to realize a company defense to prohibit unauthorized entry of a third party or, among concerned people of a corresponding company, an outsider who is not a person in charge, and this has provided a certain level of effect.

For a higher level of security for new advanced information etc. of a company including management of especially important information of respective departments, access of concerned people inside and outside the company has been more tightly controlled by checking specially approved IDs by a security guard, security codes, pass cards, fingerprint authentication, and face authentication, etc.

Patent Literature 1 describes a behavior monitoring system that transmits a warning when behavior pattern information being positions in association with time and a current position of the mobile terminal do not match each other, the behavior pattern information is prepared in advance by a surveillant or prepared based on results of continuous acquisition of positional information of a mobile terminal that a monitored person carries with him/her.

CITATION LIST

Patent Literature

[Patent Literature 1] JP 2003-281694 A

SUMMARY OF INVENTION

Technical Problem

A conventional security system can control access to and exit from a corresponding facility by ID checking, a password, fingerprint authentication, and a security code, etc., however, it cannot check a positional location and a behavior of each person after the access and exit, and may allow improper acquisition of information and suspicious behavior.

For example, an authorized concerned person can freely access and act in a facility, laboratory, and an IT software development section, etc., keeping specific confidential information. In some cases, the person can freely enter even a department that he/she is not in charge of, and browse information if a PC password and a key can be collated. Further, in some cases, if a person is checked by his/her ID, knows a password, is authenticated by his/her fingerprint, or knows a security code, the person can open a desk or a PC of another person in charge of work not relevant to his/her own work or a responsible person in charge of upper management, and improperly acquire specific company information during or outside of business hours.

Therefore, the behavior monitoring system described in Patent Literature 1 monitors such improper behavior, however, in actuality, people often behave irregularly, and therefore, the system may over issue warnings and result in overlooking a critical improper behavior.

In current company activities, security is still insufficient.

An object of the present invention is to provide a digital future-now security system, method, and program capable of accurately preventing a real improper behavior, etc., of a person who is not excluded by conventional security checks.

Solution to Problem

A digital future-now security system according to the present invention comprises a layout information storage means for storing layout information of a surveillance target area; a positional information acquiring means for acquiring positional information of mobile terminal devices that a plurality of employees carry with them in the surveillance target area; a behavior pattern storage means for successively storing, as normal patterns, behavior patterns, the behavior pattern is positions of the mobile terminal device acquired by said positional information acquiring means in association with time; and a control means for determining whether a current position of the mobile terminal device acquired by the positional information acquiring means corresponds to the normal pattern stored in the behavior pattern storage means, and issuing a warning when the current position deviates from the normal pattern and any other mobile terminal device is not present within a predetermined distance from the position.

The control means can immediately respond to a case where a person deviating from the "normal pattern" intentionally does not respond by issuing a warning when a state where the mobile terminal device does not return an answer-back continues for a predetermined period of time, and promptly prevent an improper behavior, etc.

The control means excludes the mobile terminal device from warning targets when the mobile terminal device is present in a non-surveilled area including a welfare area, and accordingly, a privacy-conscious system can be configured.

The control means excludes the mobile terminal device from warning targets when, in an area in which the mobile terminal device is currently positioned, a mobile terminal device of a responsible person in charge of the area is present, and accordingly, surveillance by the manager is expected, and an unnecessary warning that poses no problem in security can be eliminated and this system can be made effective.

A digital future-now security method according to the present invention comprises a layout information storing step of storing layout information of the surveillance target area, a positional information acquiring step of acquiring positional information of mobile terminal devices that a plurality of employees respectively carry with them in the surveillance target area, a behavior pattern storing step of successively storing, as normal patterns, behavior patterns, the behavior pattern is positions of the mobile terminal device acquired in said positional information acquiring step in association with time, and a control step of determining whether a current position of the mobile terminal device acquired in the positional information acquiring step corresponds to the normal pattern stored in the behavior pattern storing step, and issuing a warning when the current position deviates from the normal pattern and any other mobile terminal device is not present within a predetermined distance from the position.

Further, the present invention provides a program that makes a computer function as a digital future-now security system that comprises a layout information storage means that stores layout information of a surveillance target area, a positional information acquiring means that acquires positional information of mobile terminal devices that a plurality of employees carry with them in the surveillance target area, a behavior pattern storage means that successively stores, as normal patterns, behavior patterns, the behavior pattern is positions of the mobile terminal device acquired by said positional information acquiring means in association with time, and a control means that determines whether a current position of the mobile terminal device acquired by the positional information acquiring means corresponds to the normal pattern stored in the behavior pattern storage means, and issuing a warning when the current position deviates from the normal pattern and any other mobile terminal device is not present within a predetermined distance from the position.

Advantageous Effects of Invention

According to the present invention, real improper behavior of a person who is not excluded by conventional security checks using a password, fingerprint authentication, and a security code, etc., can be accurately prevented.

BRIEF DESCRIPTION OF DRAWINGS

FIG. 4 is a table showing areas within a surveillance target area that the monitoring device of the digital future-now security system according to the embodiment of the present invention monitors and ranges of works of persons in charge.

FIG. 5A is a table showing a normal management structure of the digital future-now security system according to the embodiment of the present invention.

FIG. 5B is a table showing an emergency special management structure of the digital future-now security system according to the embodiment of the present invention.

DESCRIPTION OF EMBODIMENTS

Hereinafter, modes for carrying out the present invention will be described in detail with reference to the accompanying drawings.

Embodiment

Figure 1:
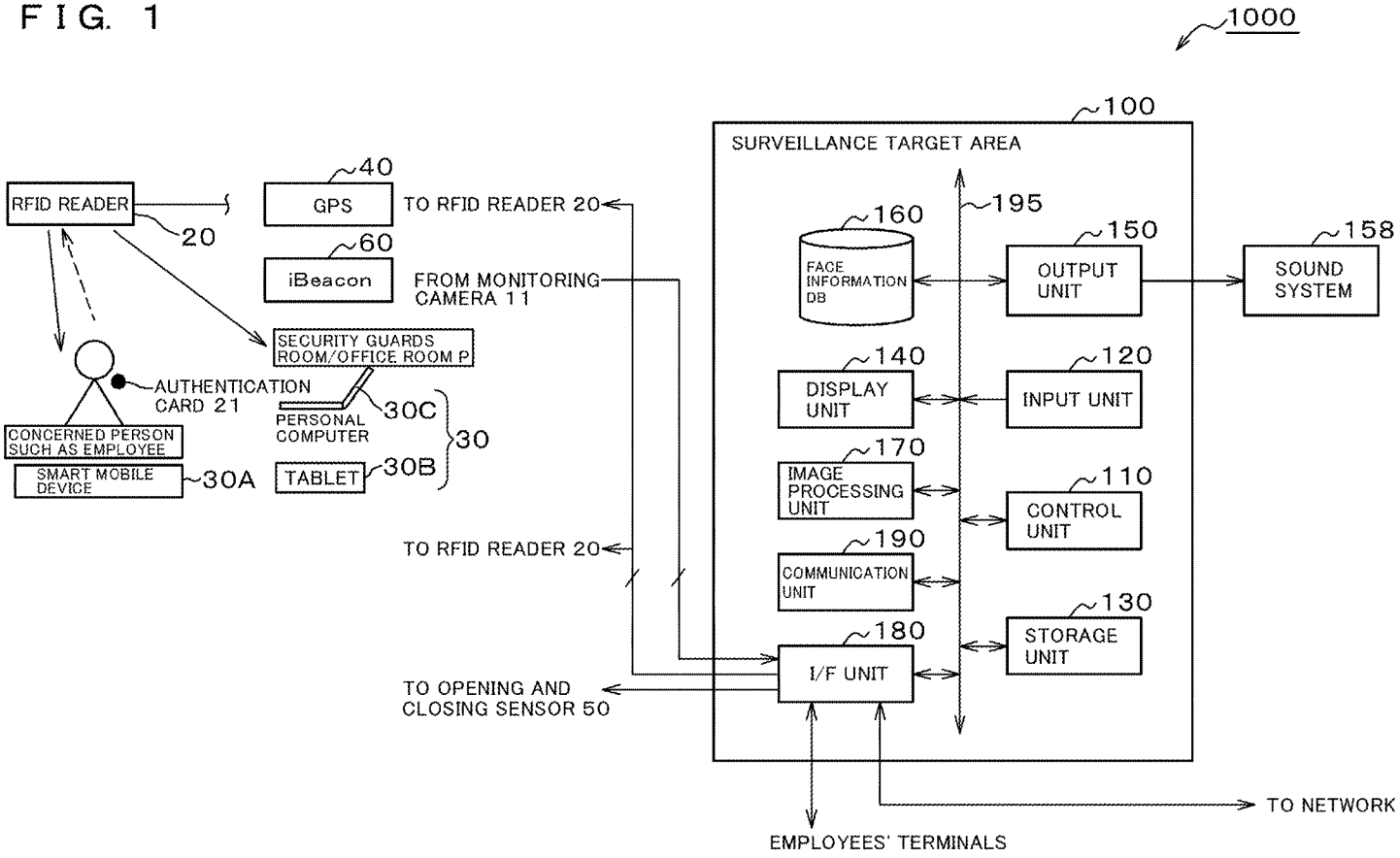
FIG. 1 is a block diagram showing a configuration of a digital future-now security system according to an embodiment of the present invention.
Figure 2:
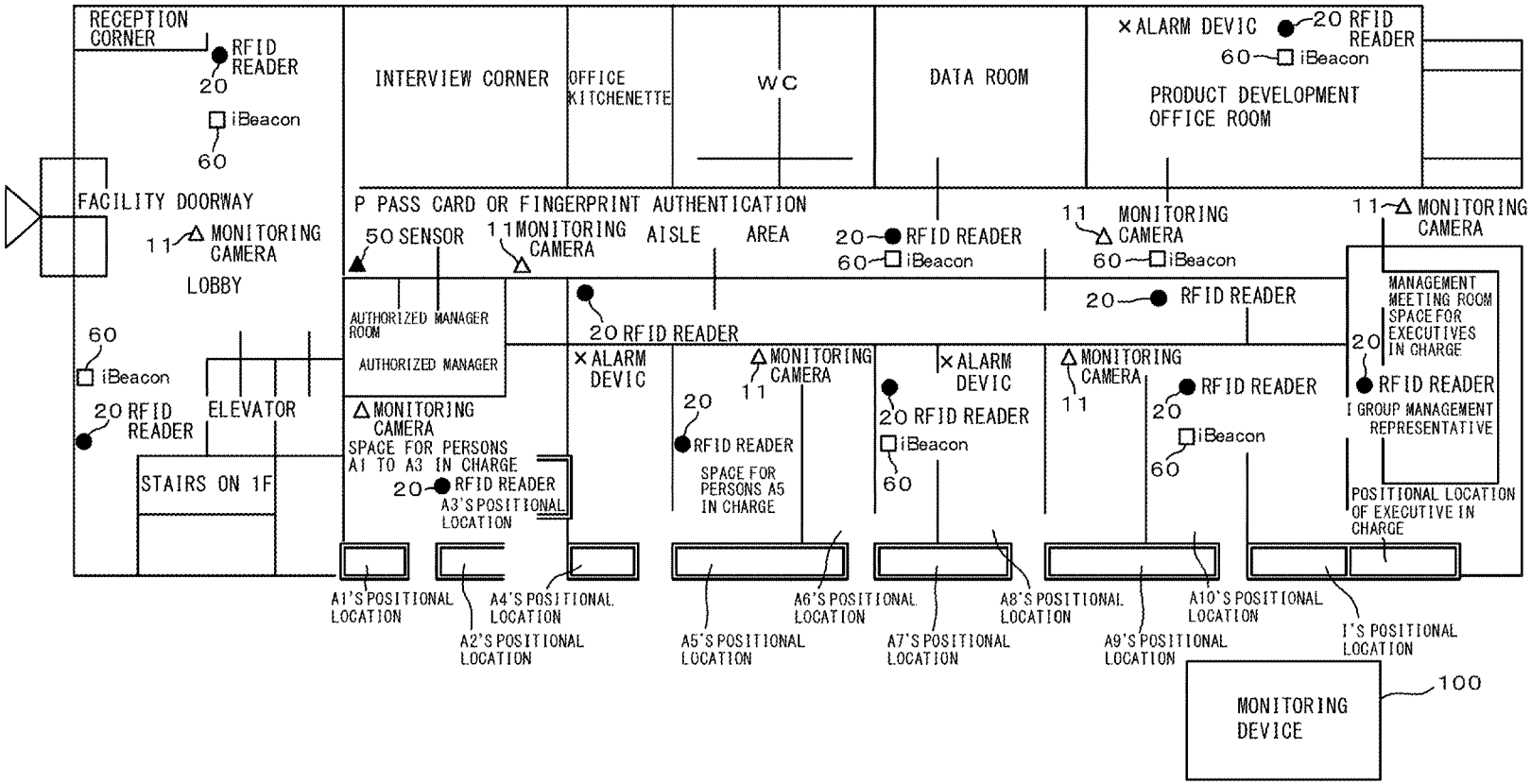
FIG. 2 is a diagram showing a surveillance target area that a monitoring device of the digital future-now security system according to the embodiment of the present invention monitors, and sensors and terminals, etc., in the area.

FIG. 1 is a block diagram showing a configuration of a digital future-now security system according to an embodiment of the present invention. FIG. 2 shows a surveillance target area that a monitoring device 100 shown in FIG. 1 monitors, and sensors and terminals, etc., in the area.

As shown in FIG. 1 and FIG. 2, a digital future-now security system 1000 comprises a plurality of monitoring cameras 11 (refer to white triangles) installed on a ceiling, etc., of the surveillance target area, a plurality of RFID (Radio Frequency IDentification) readers 20 (refer to black circles) installed in the surveillance target area including a lobby, authentication cards 21 that concerned persons such as employees (hereinafter, also referred to as "employees") carry with them and are authenticated by the RFID readers 20, mobile terminal devices 30 that the employees carry with them, a GPS (Global Positioning System) 40 that captures positions of the employees in the surveillance target area, an opening and closing sensor 50, iBeacons (registered trademark) 60 (refer to white squares), and a monitoring device 100 that controls the entire system. A1 to A10 denote persons in charge and their arranged positions, and I denotes a group management representative. Cross marks denote warning devices such as burglar alarms.

The digital future-now security system 1000 monitors videos shot by the monitoring cameras 11 installed to shoot the surveillance target area including a lobby, prevents an act of theft, tampering, or leaking information by a suspicious person, and monitors behavior of a person after he/she enters or exists from the facility in real time even if the person is admitted to the facility and prevents improper behavior.

<Monitoring Camera 11>

The monitoring cameras 11 are cameras for authentication that shoot persons' faces. The monitoring cameras 11 are installed at various positions in the surveillance target area such as a back facility being a staff-only area including a truck yard where unauthorized entry is prohibited, and shoot persons' faces. Images shot by the monitoring cameras 11 are output to the monitoring device 100. The monitoring camera 11 may shoot a moving image at all times, or may shoot a single still image every certain period of time (for example, a few seconds). As the monitoring camera 11, a PTZ camera can be used. A PTZ camera is a camera (specifically, a CCD camera or a network camera) having three functions of panning, tilting, and zooming. Panning is to turn the lens of the camera leftward or rightward. Tilting is to move the lens up and down. Zooming is movement to telephoto side and wide-angle side.

<RFID Reader 20>

The RFID reader 20 is, generally, for managing the settlement or the like of a commodity with an RF tag by detecting whether there is an answer-back in response to a transmission to the RF tag attached to the commodity. In addition, the RF tag is removed from or disabled in an article having been brought into a state of being able to be rightfully taken out of a store by being purchased or the like.

In the present embodiment, the RFID reader 20 authenticates the authentication card 21 that an employee possesses. The RFID reader 20 captures a position of the employee carrying the authentication card 21 with him/her by the authentication of the authentication card 21 that the employee possesses. This authentication card 21 is an example of the mobile terminal device in claims.

Also, in the present embodiment, a person who does not possess the authentication card 21 despite being shot by the monitoring camera 11 is identified as a suspicious person.

In addition, in the present embodiment, there is an example of the authentication card 21 using an RFID authentication card that performs authentication with the RFID reader 20, but the authentication card may be by any authentication means. Also, the authentication card 21 is merely referred to as being in a card shape for convenience of description, and may not necessarily be in a card shape to be an authentication tag or the like.

<Mobile Terminal Device 30>

The mobile terminal devices 30 are respectively carried by a plurality of employees with them. Examples of the mobile terminal devices 30 are smartphones 30*a*, tablets 30*b*, and notebook PCs 30*c*. Other examples of the mobile terminal devices 30 are mobile telephones, PHS (Personal Handy-Phone System) phones, PDAs (Personal Digital Assistants), and dedicated terminals. In the present embodiment, the mobile terminal device 30 can be used by each employee at a variety of locations (that is, current position), and can receive an e-mail message, a video including a moving image, or the like from the monitoring device 100 via a telephone line (not shown).

In the present embodiment, the mobile terminal devices 30 are used as the smartphones 30*a* or the tablets 30*b*, and each individual can use the same at a variety of locations (that is, current position). One of the mobile terminal devices 30 is disposed at headquarters/a head office (not shown).

The mobile terminal device 30 may have a configuration comprising the GPS 40 that captures the position of the employee.

The mobile terminal device 30 transmits current positional information when receiving a "positional information acquisition request" from the control unit 110 of the monitoring device 100. The mobile terminal device 30 includes a response-inability setting unit (response-inability setting means, not shown) that sets in advance inability of response to information transmitted from the control section 110 (refer to FIG. 5) of the monitoring device 100 described later. The mobile terminal device 30, when response inability has been set by the response-inability setting unit, returns an answer-back of said response inability if transmission of information is received from the control unit 110 of the monitoring device 100.

<GPS 40>

The GPS 40 receives radio waves of positional information from a GPS satellite or the like. The GPS 40 calculates, from information received via a GPS antenna, current positional information as three parameters of the latitude, longitude, and altitude to acquire positional information. The acquired positional information is transmitted on a timely basis to the monitoring device 100.

The opening and closing sensor 50 detects entry and exit of people by detecting opening and closing of a door.

In addition, in the present embodiment, the example using an RFID reader and a GPS satellite has been mentioned as a means to acquire positional information, but other than these, it may be a system using a positional relationship with a base station. For example, when an Android® smartphone or a highly functional mobile phone with a camera is used as the mobile terminal device 30 being a mobile terminal, it is also possible to acquire current positional information of its own terminal through approach checking by performing transmission/reception of information with a mobile phone company server via a base station and mobile telephone communication network (not shown) used in place of GPS 40 or in combination therewith.

Also, positional information acquisition by Wi-Fi positioning, that is, positional information acquisition using a Wi-Fi access point and a predetermined positional information service may be used.

Also, it is possible to acquire current positional information of a smartphone from a radio wave intensity of a broadcast radio wave of BLE (Bluetooth Low Energy) (Bluetooth is a registered trademark) from a beacon terminal such as an iBeacon® 60 by receiving the broadcast radio wave by smartphone. The iBeacon 60 can be used instead of or in combination with the RFID reader 20 to capture a position of an employee.

[Monitoring Device 100]

The monitoring device 100 is installed in, for example, a control room of the facility, and centrally controls the surveillance target area in the facility. The monitoring device 100 may be a common server computer, a personal computer, or the like.

The monitoring device 100 comprises a control unit 110 (control means), an input unit 120, a storage unit 130, a display unit 140, an output unit 150, a face information database (DB) 160 (face image storing means), an image processing unit 170, an interface (I/F) unit 180, and a communication unit 190, and the respective units are connected by a bus 195.

When it has been detected that a person being a suspicious person has showed up at the facility, the monitoring device 100 notifies information on this person and facility information to the headquarters/head office and a security company system through a network. As described later, in a case where a behavior pattern of the mobile terminal device 30 deviates from the "normal pattern," and a warning is issued to this mobile terminal device 30 but is ignored, this case is handled in the same manner as in the case of a suspicious person described above, and is notified to the security company system, etc.

In the following, when the subject is described as "the XX unit," the control unit 110 reads out respective programs from a ROM as needed and then loads the same in a RAM, and executes respective functions (described later). The respective programs may be stored in advance in the storage unit 130, or may be taken into the monitoring device 100 when necessary via another storage medium or communication medium.

The control unit 110 is formed by a CPU (Central Processing Unit) or the like, and controls the monitoring device 100 as a whole and executes a monitoring program to function as a digital future-now security system. A detailed configuration of the control unit 110 will be described later.

The input unit 120 is an input device for a user of the monitoring device 100 to input instructions and the like to the monitoring device 100, such as a keyboard, a mouse, a touch panel provided on a screen of the display unit 140, and a microphone.

The storage unit 130 stores still and/or moving images received from the monitoring cameras 11 and various data, programs, etc., to be used by the control unit 110.

The display unit 140 displays images received from the monitoring cameras 11, a GUI (Graphical User Interface) to operate the monitoring device 100, etc., including operating conditions of the monitoring device 100.

The output unit 150 is, for example, an audio interface, and outputs to a sound system 158 in a store a sound signal from the monitoring device 100. The sound signal to be output from the monitoring device 100 to the sound system 158 may be, for example, a sound signal input via a voice input device such as a microphone provided in the input unit 120 or a sound signal of music data stored in the storage unit 130 that is played by the control unit 110. The sound system 158 comprises an amplifier and a plurality of speakers disposed in a store, and makes an announcement in a store of a sound signal input from the monitoring device 100.

The face information DB 160 accumulates face images (face information) of suspicious persons and store concerned persons, etc.

The image processing unit 170 performs a predetermined processing to a received image. Examples of the predetermined processing include contour extraction, image resizing, and resolution converting processing.

Also, the image processing unit 170 performs image processing such as applying a red or yellow frame to a face image to be transmitted to the employee's mobile terminal device 30.

The I/F unit 180 connects each monitoring camera 11 disposed in the surveillance target area and the monitoring device 100. Also, the I/F unit 180 connects with each RFID reader 20 disposed in the surveillance target area, and sends out an authentication result of the authentication card 21 an employee who approached the RFID reader 20 possesses to the monitoring device 100. Also, the I/F unit 180 connects to the headquarters/head office, security company, and the like (not shown) by a network or dedicated line. As basic data such as persons' faces registered in the face information DB 160, data is acquired from the headquarters/head office, security company, and the like (not shown) via the I/F unit 180 to construct the face information DB 160. Also, exchanging information with the headquarters/head office, security company, and the like (not shown) can update each other's face information DBs to ones of the latest face images (face information). In addition, the security company is not an essential structural element of the digital future-now security system according to the present embodiment.

The communication unit 190 transmits/receives data with respect to the mobile terminal device 30 via a base station. In the present embodiment, the communication unit 190 receives positional information of each mobile terminal device 30 every certain period of time from the mobile terminal device 30 via the base station, and when a suspicious person (A suspicious person includes an employee who ignores a warning. The same applies to the following description.) is recognized, transmits information (such an e-mail message or a video including a moving image) regarding the suspicious person.

[Control Unit 110]

Figure 3:
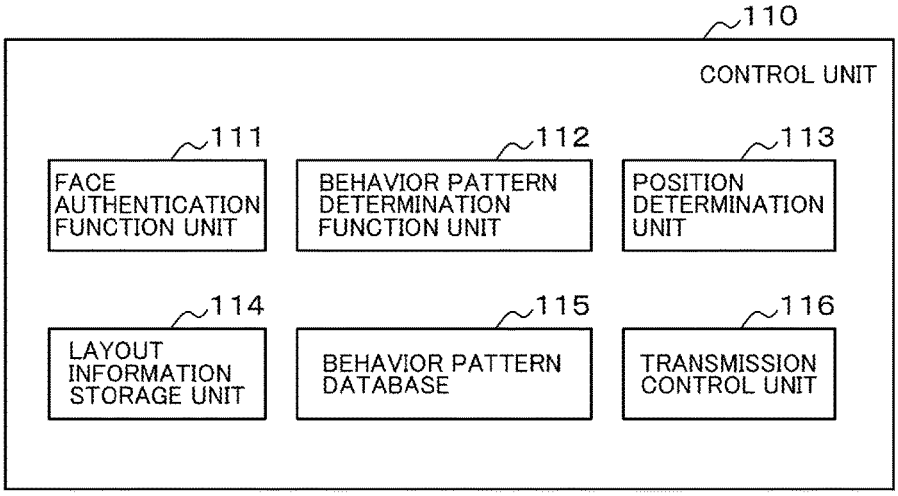
FIG. 3 is a block diagram of a control unit of the monitoring device of the digital future-now security system according to the embodiment of the present invention.

FIG. 3 is a block diagram of the control unit 110 of the monitoring device 100 of the digital future-now security system according to the embodiment of the present invention.

As shown in FIG. 3, the control unit 110 comprises a face authentication function unit 111, a behavior pattern determination function unit 112 (control means) that determines a behavior pattern, a position determination unit 113 (position information acquiring means) that determines positions of employees, a layout information storage unit 114 (layout information storing means) that stores layout information of the surveillance target area, a behavior pattern database (DB) 115 (behavior pattern storing means) that accumulates behavior patterns of persons and stores them as normal patterns, and a transmission control unit 116 that, based on acquired positional information, transmits information regarding a suspicious person preferentially to a mobile terminal device 30 closest to the suspicious person. In this case, the information is preferably transmitted to a mobile terminal device 30 close to the suspicious person in terms of time to be taken for a person in charge to respond than a mobile terminal device 30 close to the suspicious person in terms of distance.

When a result of collation by the face authentication function unit 111 is a match (a non-match with face images of authorized persons and a match with a face image of the suspicious person), the control unit 110 determines a position of a mobile terminal device 30 closest to the suspicious person the collation result with whom is a match based on positional information acquired from the position determination unit 113, and transmits information on the suspicious person to this mobile terminal device 30.

When a predetermined time elapses after transmission of information on the suspicious person to the mobile terminal device 30, or the response-inability setting unit returns an answer-back of response-inability, the control unit 110 determines a position of a mobile terminal device 30 second closest to the suspicious person the collation result with whom is a match, and transmits information on the suspicious person to this mobile terminal device 30.

Here, the information regarding the suspicious person includes information of the position of the suspicious person and the position of the employee overlapped on the surveillance target area. The information regarding the suspicious person includes a face image of the suspicious person present in the surveillance target area.

<Face Authentication Function Unit 111>

The face authentication function unit 111 performs face authentication to determine whether the face of a person included in an image received from the monitoring camera 11 is any of the persons' faces registered in the face information DB 160. The face authentication can be performed based on similarity of face information extracted from a received image to the face information registered in the face information DB 160. Specifically, if the face information includes template images, similarity between the template images can be determined.

Also, the face authentication function unit 111 acquires, from face regions, information representing humans' facial characteristics (face information) to be used for face authentication, and registers the information in the face information database (DB) 160 in association with the individual images. Also, the face authentication function unit 111 receives persons' images transmitted from the headquarters (not shown) and registers the images in the face information DB 160.

In the present embodiment, the face authentication function unit 111 registers the following face information and related information.

Registration of persons issued with RFID authentication cards

Registration of store concerned persons etc.

Registration of employee concerned persons etc.

And, in some cases,

Registration of persons other than those registered with RFID authentication cards Registration of faces of suspicious persons or suspicious vehicle drivers In the present embodiment, the face authentication function unit 111 registers face images of persons authenticated in the surveillance target area such as a back facility. This digital future-now security system is a system that monitors incoming and outgoing suspicious persons in a surveillance target area. Face information of suspicious persons or suspicious vehicle drivers can be accumulated to some extent beforehand, but it is difficult to have accumulated face information of all suspicious persons. If a mode is employed in which only the face information of suspicious persons is collated for authentication, an act of theft and the like by an overlooked suspicious person cannot be prevented, so this digital future-now security system cannot be made effective.

Therefore, in the present embodiment, face images of persons (persons issued with RFID authentication cards, store concerned persons, employee concerned persons, etc.) authenticated in the surveillance target area such as a back facility are registered, and when a face image of a person who accesses the surveillance target area such as a back facility does not match any of the registered person's face images, the person is determined to be a suspicious person. Also, the face authentication function unit 111 in combination also performs registering face images of suspicious persons, and can in this case immediately determine a suspicious person by an authentication collation of the face images of suspicious persons.

<Behavior Pattern Determination Function Unit 112>

The behavior pattern determination function unit 112 determines whether a behavior pattern, at the time of acquisition of positional information of the mobile terminal device 30, corresponds to the "normal pattern" stored in the behavior pattern DB 115, and when it deviates from the "normal pattern," performs control to issue a warning to this mobile terminal device 30. A detailed example of the warning is described later.

<Position Determination Unit 113>

The position determination unit 113 acquires positional information of employees in the surveillance target area by GPS positional information or the RFID readers 20. Specifically, the position determination unit 113 acquires positional information of an employee in the surveillance target area through authentication of the authentication tag that the employee carries with him/her by the plurality of RFID readers 20 installed in the surveillance target area. In this case, when an employee approaches each RFID reader 20, the position determination unit 113 determines that the employee is in proximity to the corresponding RFID reader 20 through authentication by each RFID reader 20 of the authentication card 21 that the employee carries with him/her. Because the installation positions of the RFID readers 20 have been registered in advance in the layout information storage unit 114, the position of the employee can be determined.

Also, the position determination unit 113 acquires positional information from a GPS function unit comprised in the mobile terminal device 30.

<Layout Information Storage Unit 114>

The layout information storage unit 114 registers surveillance area layout information in advance based on positions of monitoring cameras 11, installation positions of the RFID readers 20, and area names, etc.

As shown in FIG. 2, information of use layout of doorways, aisles, areas, required rooms, spaces, and positional locations in the facility, and spaces and positional locations, that an executive in charge, a group management representative, persons A1 to A3 in charge and persons A4 to A10 in charge use, are stored in the layout information storage unit 114 (refer to FIG. 3) in advance. Installation positions of the RFID readers 20, the GPS, and the monitoring cameras 11 are also stored in the layout information storage unit 114 (refer to FIG. 3) in advance.

In the example shown in FIG. 2, the monitoring camera 11 in the lobby is focused on a facility visitor who enters and exits from the facility, and monitors the visitor during the visit.

<Behavior Pattern DB 115>

The behavior pattern DB 115 accumulates behavior patterns, the behavior pattern is positions of the mobile terminal device 30 on the layout in association with time, and stores them as normal patterns.

<Transmission Control Unit 116>

If a result of collation by the face authentication function unit 111 is a match (a non-match with an authenticated person's face image, or a match with a suspicious person's face image), the transmission control unit 116 determines as position of a mobile terminal device 30 closest to the suspicious person the collation result with whom is a match based on the positional information acquired from the position determination unit 113, and transmits information regarding the suspicious person to this mobile terminal device 30.

Here, the suspicious person also includes a person who carries a mobile terminal device 30 the behavior pattern of which deviates from the "normal pattern," and ignores a warning although the warning is issued to this mobile terminal device 30.

The transmission control unit 116 transmits sounds, a moving image, and positional information (information with a mark on the layout) of the suspicious person to an employee closest to the position of the suspicious person by e-mail. In the case where the facility has a plurality of floors, closeness is judged for each floor. The information is transmitted in a distinguishable manner in which, for example, a person showing habitual suspicious behavior is displayed in red and a mere suspicious person is displayed in yellow.

If there is no answer-back signal from the employee to whom the transmission was addressed even after an elapse of a predetermined time (for example, five seconds), the transmission control unit 116 chooses a second employee concerned person to perform a re-transmission to him/her. The second employee concerned person is (1) an employee concerned person second closest to the suspicious person, (2) a security guard, a store manager, an assistant store manager, (3) the headquarters/head office, or the like.

FIG. 4 is a table showing areas that is a surveillance target area that the monitoring device 100 monitors and ranges of works of persons in charge (employees). FIG. 4 substantially corresponds to the surveillance target area shown in FIG. 2. A1 to A10 denote persons in charge and their arranged positions.

A person in charge (employee) executes a work based on a work plan submitted in advance to and determined by an authorized manager. For example, users of each area, space, and positional location are determined in each facility. (Conceptual largeness: facility>area>space>positional location)

The persons A1 to A10 in charge perform work behavior at their positional locations in a predetermined layout. The same applies to a group management representative (hereinafter, also referred to as a "manager"), an authorized manager, and an executive in charge.

The "person A in charge" is permitted to work at the positional location "person A in charge," but is not permitted to work at the positional location "person B in charge." That is, even in a case where the "facility, area, and space" are the same among the "facility, area, space, and positional location," when the "positional location" differs between the "person A in charge" and "person B in charge," if the "person A in charge" works at the "positional location" of the "person B in charge," this corresponds to the case where the a behavior pattern of the "person A in charge" deviates from the "normal pattern." This is a spatial element of the behavior pattern. Even when a person in charge is a permitted person in charge, if the date, day, and time of his/her behavior deviates from the normal behavior pattern, or no work schedule is transmitted in advance, this corresponds to the case of deviation from the "normal pattern."

Description is given by referring to the surveillance target area shown in FIG. 2. The persons A1 to A3 in charge can use their own spaces, however, for the person A1 in charge, the positional locations of the person A2 in charge and the person A3 in charge are out of the "normal patterns." To the contrary, for the person A2 in charge and the person A3 in charge, the positional location of the person A1 in charge is out of the "normal pattern." The same applies to the persons A4 to A10 in charge, and entry, stay, and work in a location other than a predetermined positional location are out of the "normal pattern." Entry, stay, and work of even the group management representative at positional locations of the persons A1 to A10 in charge and an executive in charge deviate from the "normal pattern." Further, a work by even an executive in charge at positional locations of the persons A1 to A10 in charge and the group management representative deviates from the "normal pattern" if the executive in charge does not submit a work schedule in advance to the authorized manager.

FIG. 5A is a table showing a normal management structure of the digital future-now security system.

As shown in FIG. 5A, when using the normal management structure, the digital future-now security system manages required rooms, areas, spaces, and positional locations in shared facilities and exclusive facilities of a facility that group concerned persons use hourly in business hours.

The management structure table shown in FIG. 5A is prepared and approved by the persons A1 to A10 in charge, the manager in charge, and the executive in charge, and submitted to the authorized manager.

FIG. 5B is a table showing an emergency special management structure of the digital future-now security system.

In the digital future-now security system, when using an emergency special management structure, the emergency special management structure shown in FIG. 5B is adopted.

For example, the emergency special management structure is used in a case where a suspicious person enters an area, a required room, a space, or a positional location in a corresponding facility, or a case where a corresponding person in charge enters a required room or positional location of another person in charge and a case where a concerned person enters the facility outside of business hours. The above-described suspicious person includes a person in charge (employee) who performed a behavior deviating from the "normal pattern" as described later. Operation description with reference to FIG. 5B is given later.

Hereinafter, the operation of the digital future-now security system configured as described above will be described.

[Registration Processing]

First, a registration processing of various information by the digital future-now security system will be described.

Figure 6:
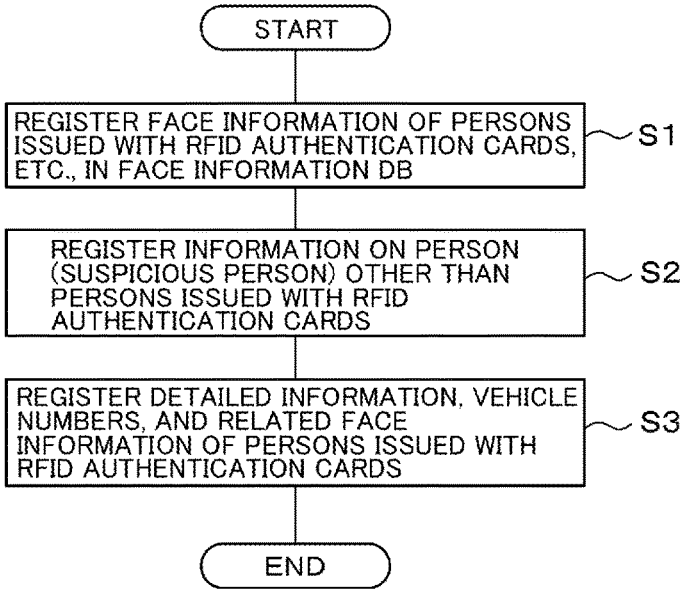
FIG. 6 is a flowchart showing person registration processing of the control unit of the monitoring device of the digital future-now security system according to the embodiment of the present invention.

FIG. 6 is a flowchart showing a registration processing of persons by the control unit 110 of the monitoring device 100 of the digital future-now security system. The present flow is executed by the control unit 110 (FIG. 5) of the monitoring device 100.

In step S1, the face authentication function unit 111 of the control unit 110 registers face information of persons issued with RFID authentication cards, store concerned persons, employee concerned persons, etc., in the face information DB 160. Specifically, the face authentication function unit 111 acquires, from face regions, information representing humans' facial characteristics (face information) to be used for face authentication, and registers the information in the face information DB 160 in association with the individual images. Also, the face authentication function unit 111 receives persons' images transmitted from the headquarters (not shown) and registers the images in the face information DB 160.

In step S2, the face authentication function unit 111 of the control unit 110 registers, in the face information DB 160, face information of persons other than the registered persons who possess the authentication cards 21 to be authenticated by the RFID readers 20. In addition, the registration of persons' face information may be, by updating a face information DB, from the headquarters/head office, security company, or the like.

In step S3, the control unit 110 performs registration of detailed information, vehicles' license numbers, and related information on the persons issued with RFID authentication cards, store concerned persons, employee concerned persons, etc.

Next, processing to accumulate behavior patterns of persons by the digital future-now security system is described.

A case where employees of a facility or the like are concerned persons whose behavior patterns are accumulated is described by way of example. The employee has an ID number in association with a department that he/she is in charge of or the like, and during work, carries a mobile terminal device 30 uniquely corresponding to his/her own ID number with him/her. In the example shown in FIG. 1 and FIG. 2, the employees are the persons A1 to A10 in charge of the respective departments.

The monitoring device 100 transmits an e-mail and sounds, etc., to the employees' mobile terminal devices 30. In addition, the monitoring device 100 transmits to mobile terminal devices 30 a positional information acquisition request that commands the mobile terminal devices 30 to transmit current positional information. When receiving the positional information acquisition request from the monitoring device 100, the mobile terminal device 30 transmits current positional information.

Figure 7:
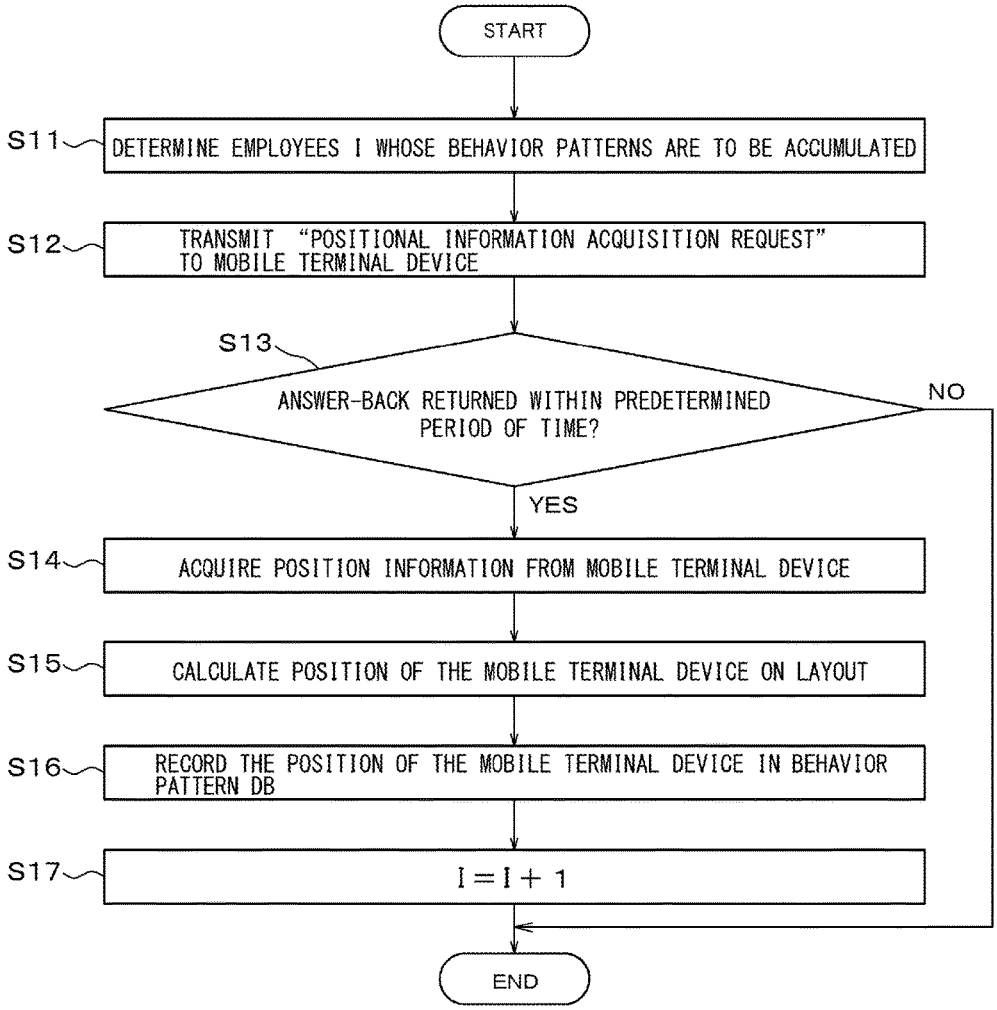
FIG. 7 is a flowchart showing processing to accumulate behavior patterns of persons by the control unit of the monitoring device of the digital future-now security system according to the embodiment of the present invention.

FIG. 7 is a flowchart showing processing to accumulate behavior patterns of persons by the control unit 110 of the monitoring device 100 of the digital future-now security system. The present flow is performed by the control unit 110 (FIG. 5) of the monitoring device 100.

First, in step S11, the behavior pattern determination function unit 112 determines employees I whose behavior patterns are to be accumulated.

In step S12, the behavior pattern determination function unit 112 transmits a "positional information acquisition request" to the mobile terminal device 30 of the employee I (hereinafter, referred to as the mobile terminal device 30). In this embodiment, a "positional information acquisition request" is transmitted by unicast to the mobile terminal device 30 of each employee I, however, a mode in which a "positional information acquisition request" is transmitted by broadcasting to mobile terminal devices 30 of all employees I can also be used.

In step S13, whether an answer-back has been returned within a predetermined time from the mobile terminal device 30 to which the "positional information acquisition request" was transmitted is determined. When no answer-back is returned even after an elapse of the predetermined time, the present flow is ended.

When an answer-back is returned from the mobile terminal device 30, in step S14, the behavior pattern determination function unit 112 acquires positional information transmitted from the mobile terminal device 30.

In step S15, the behavior pattern determination function unit 112 collates facility layout information stored in the layout information storage unit 114 and the acquired positional information and calculates a position of the mobile terminal device 30 on the facility layout.

In step S16, the behavior pattern determination function unit 112 records the position of the mobile terminal device 30 on the facility layout at the time of acquisition of the positional information in the behavior pattern DB 115. By repeatedly performing the present flow, information on when and where the mobile terminal device 30 was present is accumulated in the behavior pattern DB 115. When the behavior pattern information of the mobile terminal device 30 accumulated in the behavior pattern DB 115 reaches a predetermined threshold or more, the behavior pattern is defined as a "normal pattern" and a flag is set. Thus, persons, times, and positions (when and where who were) are recorded in the behavior pattern DB 115, and when behavior patterns equal to or more than a predetermined threshold are accumulated, these serve as the "normal pattern" that can be referred to.

In step S17, the behavior pattern determination function unit 112 increments (I=I+1) the behavior pattern acquisition processing step for the employees I, and ends the present flow. Accordingly, behavior patterns of all employees are stored, and accumulated as "normal patterns" in the behavior pattern DB 115. In the example shown in FIG. 1 and FIG. 2, behavior patterns of the persons A1 to A10 in charge of the respective departments, that is, persons, times, and positions (when and where who were) are stored, and accumulated as normal patterns.

For a specific employee (for example, a person who can access important information, a person who particularly needs to be monitored), the behavior pattern acquisition frequency may be increased. Alternatively, at the time of attendance and leaving, or for an employee who locates near a doorway of the facility on the layout, the behavior pattern acquisition frequency may be decreased. With this configuration, "normal patterns" of the employees can be more accurately accumulated, and a processing load on the monitoring device 100 can be reduced.

[Monitoring Control of Monitoring Device 100]

Figure 8:
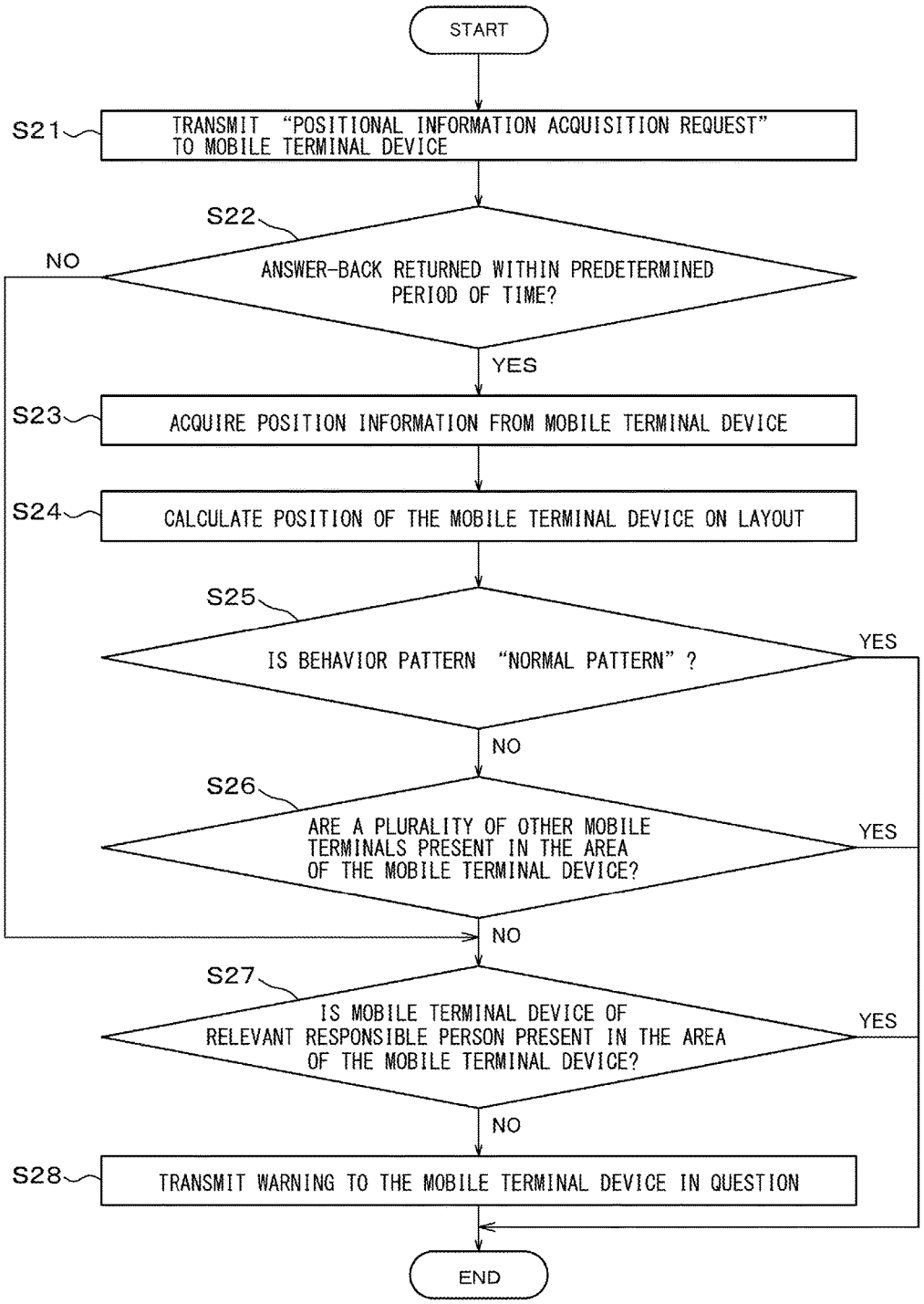
FIG. 8 is a flowchart showing monitoring control processing of the monitoring device of the digital future-now security system according to the embodiment of the present invention.

FIG. 8 is a flowchart showing monitoring control processing of the monitoring device 100 of the digital future-now security system.

FIG. 8 is a flowchart showing warning processing for a behavior pattern of a person by the control unit 110 of the monitoring device 100 of the digital future-now security system. The present flow is performed by the control unit 110 (FIG. 5) of the monitoring device 100.

First, in step S21, the behavior pattern determination function unit 112 transmits a "positional information acquisition request" to the mobile terminal devices 30 of employees whose behavior patterns are monitored (hereinafter, referred to as the mobile terminal devices 30). In the example shown in FIG. 1 and FIG. 2, the "positional information acquisition request" is transmitted to the mobile terminal devices 30 of the persons A1 to A10 in charge of the respective departments. The "positional information acquisition request" may be transmitted by unicast to the mobile terminal device 30 of each employee, or may be transmitted by broadcasting to the mobile terminal devices 30 of all employees.

In step S22, the behavior pattern determination function unit 112 determines whether an affirmative acknowledgement (Ack) has been returned within a predetermined time from the mobile terminal device 30 to which the "positional information acquisition request" was transmitted. When no acknowledgement is returned after an elapse of the predetermined time, the process advances to step S28, and the behavior pattern determination function unit 112 transmits a warning to this mobile terminal device 30 in question and ends the present flow. A detailed example of the warning is described later.

When an affirmative acknowledgement (Ack) is returned from the mobile terminal device 30, in step S23, the behavior pattern determination function unit 112 acquires positional information transmitted from the mobile terminal device 30.

In step S24, the behavior pattern determination function unit 112 collates store layout information stored in the layout information storage unit 114 and the acquired positional information, and calculates a position of the mobile terminal device 30 on the layout.

In step S25, the behavior pattern determination function unit 112 determines whether a behavior pattern of this mobile terminal device 30 in question is the "normal pattern" by referring to the behavior pattern DB 115.

When the behavior pattern of the mobile terminal device 30 in question is the "normal pattern," the present flow is ended. In this case, behavior pattern information of the mobile terminal device 30 in question accumulated in the behavior pattern DB 115 may be updated. This can improve the behavior pattern information accuracy of the behavior pattern DB 115.

In step S25 described above, when the behavior pattern of the mobile terminal device 30 in question is not the "normal pattern," the process advances to step S26. When the behavior pattern is the "normal pattern," the present flow is directly ended.

In step S26, the behavior pattern determination function unit 112 determines whether a plurality of other mobile terminal devices 30 are present in the area of the mobile terminal device 30 in question.

When a plurality of other mobile terminal devices 30 are not present in the area of the mobile terminal device 30 in question, the process advances to step S27. Even when the behavior pattern of the mobile terminal device 30 deviates from the "normal pattern," if a plurality of persons are present in the area, this mobile terminal device is judged as posing no problem in security, and is excluded from warning targets.

In step S27, the behavior pattern determination function unit 112 determines whether a mobile terminal device 30 that a relevant responsible person carries with him/her is present in the area of the mobile terminal device 30 in question.

When the mobile terminal device 30 that the relevant responsible person carries with him/her is not present in the area of the mobile terminal device 30 in question, the process advances to step S28. Even when the behavior pattern of the mobile terminal device 30 deviates from "normal pattern," if a responsible person is there, this mobile terminal device is judged as posing no problem in security, and excluded from warning targets.

In step S28, the behavior pattern determination function unit 112 transmits a warning to the mobile terminal device 30 in question and ends the present flow. This warning is, for example, for a suspicious person, e-mail transmission to the mobile terminal device 30 or an alarm (alarm sound) generated by the mobile terminal device 30, and for a person in charge, a positional location of the suspicious person on the layout, a face image and a moving image, etc., of the suspicious person shot by the monitoring camera 11. However, even if a behavior pattern of the mobile terminal device 30 deviates from the "normal pattern," this cannot be directly regarded as a suspicious behavior. Therefore, a mode in which a warning to the mobile terminal device 30 is weighted is possible. For example, when a behavior pattern deviates from the "normal pattern" in the first warning processing, an e-mail to remind attention is transmitted, and when the state where the behavior pattern deviates from the "normal pattern" still continues in the second and subsequent warning processing, an alarm (alarm sound) and an e-mail containing a stronger warning are transmitted. When the mobile terminal device 30 in question enters an important region clearly different from its own department or enters the facility at an improbable time, a stronger warning may be issued.

Here, private areas such as the bathroom and welfare areas such as a break room are defined as non-surveilled areas and excluded from surveillance targets. Accordingly, monitoring can be prevented from being taken as privacy violation.

In step S22 described above, when a completely stationary condition such as no return of an affirmative acknowledgement continues for a predetermined period of time, in step S28, the behavior pattern determination function unit 112 deems the mobile terminal device 30 to have been left, and issues a warning in the same manner.

In step S26 described above, in the area of the mobile terminal device 30 in question, when a plurality of other mobile terminal devices 30 are present, even if a behavior pattern of the mobile terminal device 30 in question deviates from the "normal pattern," a plurality of persons are present in the area, so that the mobile terminal device in question is judged as posing no problem in security and excluded from warning targets, and the present flow is ended.

In step S27 described above, when a mobile terminal device 30 that a relevant responsible person carries with him/her is present in the area of the mobile terminal device 30 in question, even if a behavior pattern of the mobile terminal device 30 deviates from the "normal pattern," a responsible person is present in the area, so that this mobile terminal device is judged as posing no problem in security and excluded from warning targets, and the present flow is ended.

Here, the monitoring device 100 may be configured to perform the following control in addition to warning when the behavior pattern of the mobile terminal device 30 deviates from the normal pattern.

That is, when an affirmative acknowledgement ACK is not returned from this mobile terminal device 30 in question even after an elapse of a predetermined time (for example, 5 seconds), or a negative acknowledgement NCK is returned from the mobile terminal device 30 in question, a position of a mobile terminal device 30 of a person in charge who is at the shortest moving time distance and can respond earliest to the mobile terminal device 30 in question is determined, and information on the warned person, that is, a floor number, a required room, and a positional location name, etc., of the positional location and a moving image shot by the monitoring camera 11 are transmitted to the mobile terminal device 30 of the person in charge. In this case, information on the warned person is also preferably transmitted to the mobile terminal device 30 of a manager who is at the shortest moving time distance and can respond earliest to the mobile terminal device in question. In the present invention, a warning is issued to at least one of the suspicious person, the person in charge, and the manager.

Application Example 1

For example, description is given by using the example shown in FIG. 1 and FIG. 2. The positions of the persons A1 to A3 in charge are assumed to be important locations in security. Behavior patterns of the persons A1 to A3 in charge are concentrated in this area, and for the persons A1 to A3 in charge, behavior patterns centered at this area are "normal patterns." On the other hand, a main arranged location of the person A5 in charge is the position A5 in FIG. 1 and FIG. 2, and for the person A5 in charge, a behavior pattern around this area is the "normal pattern."

When it is assumed that the person A5 in charge has gone to the product development office room at the upper right in FIG. 1 or FIG. 2, this is regarded as a behavior deviating from the "normal pattern," and this system issues a warning to the mobile terminal device 30 of the person A5 in charge (step S28 described above). However, when a responsible person is in this product development office room, this mobile terminal device is judged as posing no problem in security and excluded from warning targets (step S27 described above).

When it is assumed that the person A5 in charge has gone to, for example, the positions A1 to A3 in FIG. 1 and FIG. 2, this behavior is regarded as deviating from the "normal pattern," and this system issues a warning to the mobile terminal device 30 of the person A5 in charge (step S28 described above). Here, at these positions A1 to A3, if a plurality of persons A1 to A3 in charge are present, this mobile terminal device is judged as posing no problem in security and excluded from warning targets (step S26 described above). When a plurality of persons in charge are not present (one or none of the persons in charge is present), the warning described above is issued to the mobile terminal device 30 of the person A5 in charge.

Even if the person A5 in charge performs a behavior deviating from the "normal pattern," welfare and shared areas such as the bathroom (WC) and the office kitchenette in FIG. 1 and FIG. 2 are non-surveilled areas and excluded from surveillance targets.

Application Example 2

Figure 9:
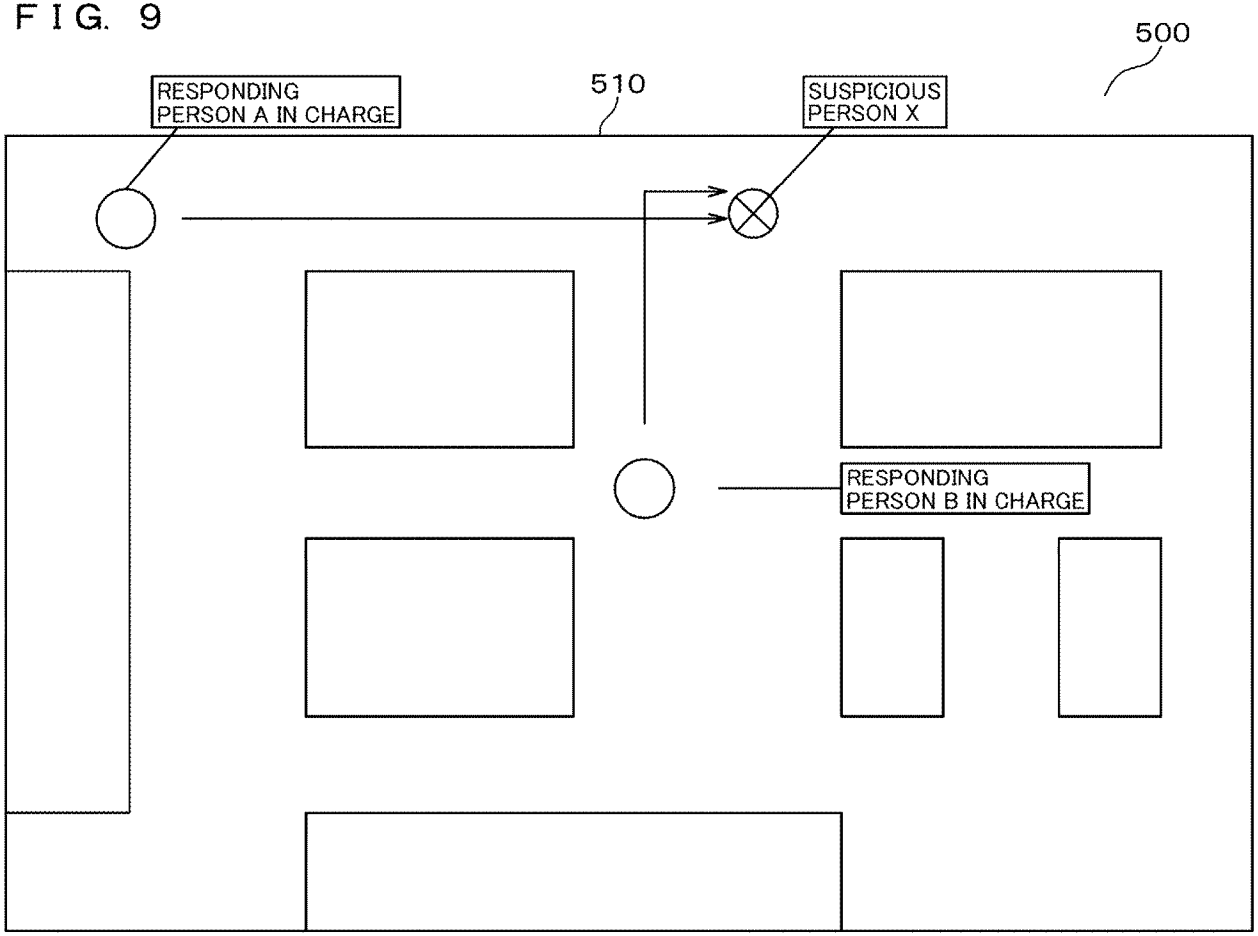
FIG. 9 is a diagram describing monitoring control of the monitoring device of the digital future-now security system according to the embodiment of the present invention.
Figure 10:
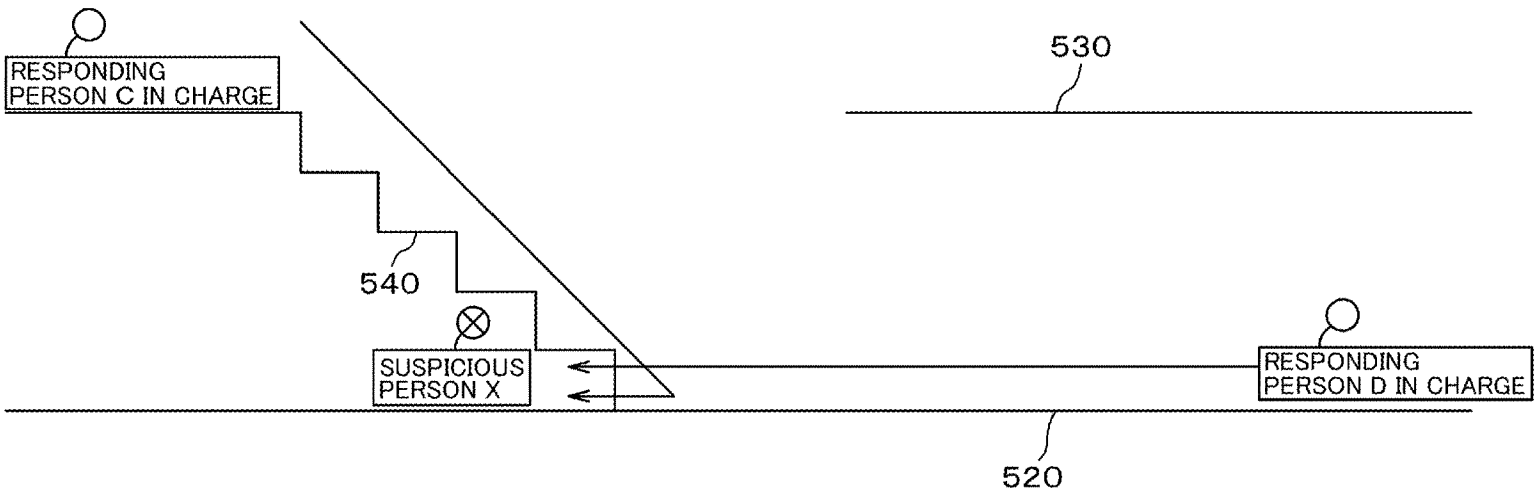
FIG. 10 is a diagram describing monitoring control of the monitoring device of the digital future-now security system according to the embodiment of the present invention.

FIG. 9 and FIG. 10 are diagrams describing monitoring control of the monitoring device 100 of the digital future-now security system.

As shown in FIG. 9, it is assumed that a suspicious person X has intruded into the floor 500 of the facility.

The suspicious person X is not an intruder who has slipped through various security checks and illegally intruded into this facility, but a person who has gone through the security checks using an ID, a password, fingerprint authentication, and a security code, etc., and cleared these checks. In detail, the suspicious person X is an employee (person in charge) who performed a behavior deviating from the "normal pattern" among the persons A1 to A10 in charge shown in FIG. 1 and FIG. 2. As long as the suspicious person is an employee of the facility, he/she passed the security checks, and therefore, such an employee who has become a suspicious person X cannot be excluded by the conventional technology. In the present embodiment, a warning is issued to an employee whose behavior pattern deviates from the "normal pattern," and when he/she performs a behavior without heeding the warning, he/she is regarded as the suspicious person X and another person A or B in charge responds to the suspicious person X. In this case, notification is given first to the mobile terminal device 30 that the person B in charge who is at the shortest moving time distance and can respond earliest to the suspicions person, carries with him/her, and when no affirmative acknowledgement ACK is returned from this mobile terminal device 30 even after an elapse of a predetermined time (for example, 5 seconds), or when a negative acknowledgement NCK is returned from this mobile terminal device, notification is given to the mobile terminal device 30 that the person A in charge who can respond next earliest carries with him/her.

Similarly, as shown in FIG. 10, it is assumed that a suspicious person X has intruded into the first floor 520 of the facility 500.

The suspicious person X is an employee (person in charge) who performs a behavior without heeding the warning. To the suspicious person X, the person C in charge descends the stairs 540 from the second floor 530 and responds, and the person D in charge responds to in the straight direction from the first floor 520. In this case, the person C in charge is at a short spatial distance to the suspicious person X, however, he/she must descend the stairs 540, so that the moving time distance of the person D in charge is the shorter. Therefore, notification is given first to the mobile terminal device 30 that the person D in charge who can respond earliest carries with him/her, and when no affirmative acknowledgement ACK is returned from this mobile terminal device 30 even after an elapse of a predetermined time (for example, 5 seconds), or when a negative acknowledgement NCK is returned from this mobile terminal device 30, notification is given to the mobile terminal device 30 that the person C in charge who can respond next earliest carries with him/her.

Application Example 3

<Normal Management Structure>

The digital future-now security system performs periodic or irregular centralized management of the facility. For example, in the digital future-now security system, periodic management, irregular management, and centralized management are performed by a management concerned person at the start, end, or in the middle of work on the first floor of a corresponding facility.

In the normal management structure, as shown in FIG. 5A, the required rooms, areas, spaces, and positional locations in the shared facilities and exclusive facilities (1) to (22) in the facility that group concerned persons use are managed at each time to start and end the work and in the middle of work.

<Emergency Special Management Structure>

The digital future-now security system shifts to the emergency special management structure shown in FIG. 5 when a suspicious person enters an area, a required room, a space, or a positional location in the corresponding facility or when a corresponding person in charge enters a required room or positional location of another person in charge and when a concerned person enters the facility outside of the business hours. As described above, this suspicious person includes a person in charge (employee) whose behavior pattern deviates from the "normal pattern."

For example, when a suspicious person is present in the surveillance target area shown in FIG. 2, the system shifts to the emergency special management structure shown in FIG. 5B. FIG. 5B shows the emergency special management structure when the suspicious person enters an area, a required room, a space, or a positional location in the corresponding facility or when a corresponding person in charge enters a required room or positional location of another person in charge and when a concerned person enters the facility outside of the business hours.

Entry of Outsider B

As shown by "S1, K" in FIG. 5B, when an outsider B enters a person-in-charge room of the person A in charge, a floor number, a required room, and a positional location name of the positional location of the outsider B are transmitted by e-mail to the mobile terminal device 30 of a manager S1 who is at the shortest moving time distance and can respond earliest to the outsider. In this case, a moving image shot by the monitoring camera 11 may also be transmitted together. In addition, this moving image may be transmitted in real time to the mobile terminal device 30 of an authorized manager K who manages and controls the corresponding facility and to the PC of an authorized manager room.

Entry of person A3 in charge into location other than his/her positional location As shown by "S, K" in FIG. 5B, when the person A3 in charge enters the positional location of the person A4 at 17 o'clock, as information to inform the behavior of the person A3 in charge, a floor number, a required room, and a positional location name of the positional location of the person A3 in charge are transmitted by e-mail to the mobile terminal device 30 of the manager S who is at the shortest moving time distance and can respond earliest. In this case, a moving image shot by the monitoring camera 11 may also be transmitted together. In addition, this moving image may be transmitted in real time to the mobile terminal device 30 of an authorized manager K who manages and controls the corresponding facility and to the PC of an authorized manager room.

Entry of person A8 in charge outside of business hours (late at night)

As shown by "S2, K" in FIG. 5B, when the person A8 in charge enters the I group manager room (IG manager room) at 3 o'clock in the early morning, although the person A8 in charge is a person concerned with the work, the time of his entry is outside of the business hours, so that a floor number, a required room, and a positional location name of the positional location of the person A8 in charge are transmitted by e-mail to the mobile terminal device 30 of a sub-manager S2 who is a sub-manager on duty at the shortest moving time distance and can respond earliest. In this case, a moving image shot by the monitoring camera 11 may also be transmitted together. In addition, this moving image may be transmitted in real time to the mobile terminal device 30 of an authorized manager K who manages and controls the corresponding facility and to the PC of an authorized manager room.

Thus, when a behavior pattern of the person deviates from the "normal pattern" as a result of collation of the behavior pattern showing a person, a time, and a position (when and where who was) with the "normal pattern," even if the person is a person in charge admitted to access the corresponding facility, the digital future-now security system can determine this as an improper behavior and issue a warning. Therefore, an improper behavior, etc., of a person in charge (employee) who is not excluded by security checks can be prevented.

As described above, according to the present embodiment, the digital future-now security system 1000 comprises the behavior pattern DB 115 that accumulates behavior patterns showing positions of the mobile terminal devices 30 on the layout and stores them as normal patterns, and the behavior pattern determination function unit 112 that determines whether a behavior pattern, at the time of acquisition of positional information of the mobile terminal device 30, corresponds to the "normal pattern" stored in the behavior pattern DB 115, and when it deviates from the "normal pattern," performs control to issue a warning to this mobile terminal device.

With this configuration, behavior of even a person admitted to enter the corresponding facility by checking with an ID, a password, fingerprint authentication, and a security code, etc., can be monitored in real time after entry or exit, and his/her improper behavior, etc., can be prevented.

In the present embodiment, by issuing a warning to a mobile terminal device when a state where this mobile terminal device does not return an answer-back continues for a predetermined period of time, the control unit 110 can immediately respond to a case where a person deviating from the "normal pattern" intentionally does not return an answer-back, and promptly prevent an improper behavior, etc.

In the present embodiment, the control unit 110 excludes a mobile terminal device from warning targets when the mobile terminal is present in a non-surveilled area including a welfare area, and accordingly, a privacy-conscious system can be configured.

In the present embodiment, the control unit 110 excludes a mobile terminal device from warning targets when a plurality of other mobile terminal devices are present around the mobile terminal device in question, and accordingly, an unnecessary warning that poses no problem in security can be eliminated and this system can be made effective.

Also, in the present embodiment, the control unit 110 excludes a mobile terminal device from warning targets when a mobile terminal device of a responsible person is present around the mobile terminal device in question, an unnecessary warning that poses no problem in security can be eliminated and this system can be made effective.

The above description is an exemplification of preferred embodiments of the present invention, and the scope of the present invention is not limited thereto. For example, in the present embodiment, a description has been given of the case of using the telephone line as a public line, but the present invention is not limited to this case, and for example, a radio communication line, the Internet, or a LAN may be used as a public line. Moreover, the communication terminal may be used according to the type of the public line, such as a transceiver used as a communication terminal when the public line is radio communication, and a personal computer or a palmtop computer used as a communication terminal when the public line is the Internet or a LAN. Thus constructing a digital future-now security system using an existing public line allows expanding the usage form of a digital future-now security system and allows suppressing the construction costs of a digital future-now security system.

Moreover, the title of a digital future-now security system and method has been used in the present embodiment, but this is for convenience of description, and the title may be digital smart security, a crime-prevention system, a security method, or the like.

Also, a digital future-now security system and method of the present invention can also be realized by a program to operate a computer as the present digital future-now security system or method. This program may be stored in a storage medium that can be read by a computer.

This storage medium recorded with the program may be a ROM itself of the present digital future-now security system, or may be a storage medium such as a CD-ROM that can be read, when a program reading device such as a CD-ROM drive is provided as an external storage device, by inserting therein the storage medium.

Moreover, the above-described storage medium may be a magnetic tape, a cassette tape, a flexible disk, a hard disk, an MO/MD/DVD or the like, or a semiconductor memory.

All publications, patents and patent applications cited in the present specification are hereby incorporated by reference in their entirety.

INDUSTRIAL APPLICABILITY

The digital future-now security system, method and program according to the present invention provide real-time responses in corporate and commercial facilities, offices, and the like to prevent loss of property and life and economic loss, whereby providing great utilization effects.

REFERENCE SIGNS LIST

11 Monitoring camera
20 RFID reader
21 Authentication card
30 Mobile terminal device
40 GPS
50 Opening and closing sensor
100 Monitoring device
110 Control unit (control means)
111 Face authentication function unit
112 Behavior pattern determination function unit (control means)
113 Position determination unit (positional information acquiring means)
114 Layout information storage unit (layout information storing means)
115 Behavior pattern database (DB) (behavior pattern storage means)
116 Transmission control unit
120 Input unit
130 Storage unit
140 Display unit
150 Output unit
160 Face information database (DB)
170 Image processing unit
180 Interface (I/F) unit
190 Communication unit
200 Back facility layout
1000 Digital future-now security system

The invention claimed is:

1. A digital future-now security system comprising:

a layout information storage means configured to store layout information of a surveillance target area;

a positional information acquiring means configured to acquire positional information of mobile terminal devices that a plurality of employees carry with them in the surveillance target area;

a behavior pattern storage means configured to successively store, as normal patterns, behavior patterns, the behavior pattern is positions of the mobile terminal device acquired by said positional information acquiring means in association with time; and a control means configured to determine whether a current position of the mobile terminal device acquired by the positional information acquiring means corresponds to the normal pattern stored in the behavior pattern storage means, and issue a warning that there is a person who performs improper behavior in security when the current position deviates from the normal pattern, any other mobile terminal device is not present within a predetermined distance from the current position, and the mobile terminal device is not present in a non-surveilled area inside the surveillance target area, wherein the non-surveilled area includes a welfare area for preventing from being taken as privacy violation.

2. The digital future-now security system according to claim 1, wherein the control means issues a warning when a state where the mobile terminal device does not return an answer-back continues for a predetermined period of time.

3. The digital future-now security system according to claim 1, wherein the control means excludes the mobile terminal device from warning targets when, in an area in which the mobile terminal device is currently positioned, a mobile terminal device of a responsible person in charge of the area is present.

4. A digital future-now security method comprising:

a layout information storing step of storing layout information of a surveillance target area;

a positional information acquiring step of acquiring positional information of mobile terminal devices that a plurality of employees respectively carry with them in the surveillance target area;

a behavior pattern storing step of successively storing, as normal patterns, behavior patterns, the behavior pattern is positions of the mobile terminal device acquired in said positional information acquiring step in association with time; and a control step of determining whether a current position of the mobile terminal device acquired in the positional information acquiring step corresponds to the normal pattern stored in the behavior pattern storing step, and issuing a warning that there is a person who performs improper behavior in security when the current position deviates from the normal pattern, any other mobile terminal device is not present within a predetermined distance from the current position, and the mobile terminal device is not present in a non-surveilled area inside the surveillance target area, wherein the non-surveilled area includes a welfare area for preventing from being taken as privacy violation.

5. A tangible non-transitory computer-readable storage medium, the computer-readable storage medium is configured to store a program executable by a digital future-now security system, the digital future-now security system upon execution of the program is configured to perform the method of claim 4.

* * * * *